US011224957B1

(12) United States Patent
Mukhopadhyay et al.

(10) Patent No.: US 11,224,957 B1
(45) Date of Patent: Jan. 18, 2022

(54) POLYCRYSTALLINE DIAMOND COMPACTS, METHODS OF MAKING SAME, AND APPLICATIONS THEREFOR

(71) Applicant: US SYNTHETIC CORPORATION, Orem, UT (US)

(72) Inventors: Debkumar Mukhopadhyay, Sandy, UT (US); Kenneth E. Bertagnolli, Riverton, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 0 days.

(21) Appl. No.: 16/672,000

(22) Filed: Nov. 1, 2019

Related U.S. Application Data

(60) Continuation of application No. 14/244,461, filed on Apr. 3, 2014, now Pat. No. 10,493,598, which is a division of application No. 13/033,436, filed on Feb. 23, 2011, now Pat. No. 8,727,045.

(51) Int. Cl.
*B24D 18/00* (2006.01)
*B24D 3/10* (2006.01)

(52) U.S. Cl.
CPC ..... *B24D 18/0009* (2013.01); *B24D 3/10* (2013.01)

(58) Field of Classification Search
CPC ..... B24D 3/10; B24D 18/0009
See application file for complete search history.

(56) References Cited

U.S. PATENT DOCUMENTS 4,268,276 A 5/1981 Bovenkerk
4,380,471 A 4/1983 Lee et al.
4,410,054 A 10/1983 Nagel et al.
4,468,138 A 8/1984 Nagel
4,560,014 A 12/1985 Geczy
4,607,711 A 8/1986 Zijsling
4,738,322 A 4/1988 Hall et al.
4,772,294 A 9/1988 Schroeder
4,811,801 A 3/1989 Salesky et al.
4,913,247 A 4/1990 Jones
4,959,929 A 10/1990 Burnand et al.
5,016,718 A 5/1991 Tandberg
(Continued)

FOREIGN PATENT DOCUMENTS

CA 2762721 A1 * 6/2012 ..... F16C 17/10
WO WO-0196050 A2 * 12/2001 ..... B22F 7/008
ZA 9902512 B 10/2000

OTHER PUBLICATIONS

Issue Notification for U.S. Appl. No. 14/244,461 dated Nov. 13, 2019.

(Continued)

*Primary Examiner* — Pegah Parvini
*Assistant Examiner* — Ross J Christie
(74) *Attorney, Agent, or Firm* — Dorsey & Whitney LLP

(57) ABSTRACT

Embodiments of the invention relate to polycrystalline diamond compact ("PDC") including a polycrystalline diamond ("PCD") table that bonded to a cobalt-nickel alloy cemented carbide substrate. The cobalt-nickel alloy cemented carbide substrate provides both erosion resistance and corrosion resistance to the cemented carbide substrate. In an embodiment, a PDC includes a cemented carbide substrate including cobalt-nickel alloy cementing constituent. The PDC further includes a PCD table bonded to the cemented carbide substrate.

9 Claims, 8 Drawing Sheets

(56) References Cited

U.S. PATENT DOCUMENTS

| | | | | |
|---|---|---|---|---|
| 5,022,894 | A | 6/1991 | Vagarali et al. | |
| 5,092,687 | A | 3/1992 | Hall | |
| 5,120,327 | A | 6/1992 | Dennis | |
| 5,127,923 | A | 7/1992 | Bunting et al. | |
| 5,135,061 | A | 8/1992 | Newton, Jr. | |
| 5,154,245 | A | 10/1992 | Waldenstroem et al. | |
| 5,180,022 | A | 1/1993 | Brady | |
| 5,364,192 | A | 11/1994 | Damm et al. | |
| 5,368,398 | A | 11/1994 | Damm et al. | |
| 5,460,233 | A | 10/1995 | Meany et al. | |
| 5,472,376 | A | 12/1995 | Olmstead et al. | |
| 5,480,233 | A | 1/1996 | Cunningham | |
| 5,505,748 | A | 4/1996 | Tank et al. | |
| 5,544,713 | A | 8/1996 | Dennis | |
| 6,248,447 | B1 | 6/2001 | Griffin et al. | |
| 6,499,547 | B2 | 12/2002 | Scott et al. | |
| 6,620,375 | B1 | 9/2003 | Tank et al. | |
| 6,793,681 | B1 | 9/2004 | Pope et al. | |
| 7,635,035 | B1 | 12/2009 | Bertagnolli et al. | |
| 2001/0008190 | A1 | 7/2001 | Scott et al. | |
| 2003/0206821 | A1* | 11/2003 | Tank | B24D 3/10 419/11 |
| 2004/0010977 | A1* | 1/2004 | Tank | C22C 26/00 51/307 |
| 2008/0314214 | A1 | 12/2008 | Tank | |
| 2009/0032169 | A1 | 2/2009 | Dourfaye et al. | |
| 2009/0152018 | A1 | 6/2009 | Sani | |
| 2011/0061944 | A1 | 3/2011 | Scott et al. | |

OTHER PUBLICATIONS

Final Office Action for U.S. Appl. No. 13/033,436 dated Oct. 9, 2013.
Final Office Action for U.S. Appl. No. 14/244,461 dated Nov. 26, 2018.
Final Office Action for U.S. Appl. No. 14/244,461 dated Oct. 19, 2017.
Issue Notification for U.S. Appl. No. 13/033,436 dated Apr. 30, 2014.
Non-Final Office Action for U.S. Appl. No. 13/033,436 dated Jun. 14, 2013.
Non-Final Office Action for U.S. Appl. No. 14/244,461 dated Apr. 17, 2018.
Non-Final Office Action for U.S. Appl. No. 14/244,461 dated Apr. 5, 2019.
Non-Final Office Action for U.S. Appl. No. 14/244,461 dated May 19, 2017.
Notice of Allowance for U.S. Appl. No. 13/033,436 dated Jan. 6, 2014.
Notice of Allowance for U.S. Appl. No. 14/244,461 dated Aug. 5, 2019.
Supplemental Notice of Allowance for U.S. Appl. No. 13/033,436 dated Jan. 31, 2014.
U.S. Appl. No. 12/185,457, filed Aug. 4, 2008.
U.S. Appl. No. 13/033,436, filed Feb. 23, 2011.
U.S. Appl. No. 14/244,461, filed Apr. 3, 2014.

* cited by examiner

POLYCRYSTALLINE DIAMOND COMPACTS, METHODS OF MAKING SAME, AND APPLICATIONS THEREFOR

CROSS-REFERENCE TO RELATED APPLICATIONS

This application is a continuation of U.S. application Ser. No. 14/244,461 filed on 3 Apr. 2014, which application is a divisional of U.S. application Ser. No. 13/033,436 filed on 23 Feb. 2011, the disclosures of each of which is incorporated herein, in their entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may also be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned on a surface of the cemented carbide substrate. A number of such containers may be loaded into an HPHT press. The substrate(s) and volume of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of a matrix of bonded diamond grains having diamond-to-diamond bonding therebetween, with interstitial regions between the bonded diamond grains being occupied by the solvent catalyst.

SUMMARY

Embodiments of the invention relate to a PDC including a PCD table that is bonded to a cemented carbide substrate including a cobalt-nickel alloy cementing constituent. The cobalt-nickel alloy cementing constituent of the cemented carbide substrate provides both erosion resistance and corrosion resistance to the cemented carbide substrate.

In an embodiment, a PDC includes a cemented carbide substrate including cobalt-nickel alloy cementing constituent. The PDC further includes a PCD table bonded to the cemented carbide substrate. The PCD table includes a plurality of bonded-together diamond grains defining a plurality of interstitial regions. In some embodiments, the PCD table may be substantially free of nickel despite the cemented carbide substrate including nickel, and include cobalt (e.g., substantially pure cobalt and/or a cobalt alloy) disposed in at least a portion of the interstitial regions thereof. The lack of a significant amount of nickel in the PCD table and the presence of cobalt in the PCD table is currently believed to catalyze diamond growth better than nickel when the PCD table is integrally formed with the cemented carbide substrate and promote mechanical integrity of the PCD table better than a nickel-infiltrated PCD table when the PCD table is a pre-sintered PCD table that is infiltrated with nickel and bonded to the cemented carbide substrate in an HPHT bonding process. In other embodiments, the cobalt-nickel alloy cementing constituent of the cemented carbide substrate may infiltrate into un-sintered diamond particles to catalyze the formation of the PCD table that includes relatively higher concentrations of nickel.

In some embodiments, the cemented carbide substrate includes a first cemented carbide portion bonded to the PCD table and a second cemented carbide portion bonded to the first cemented carbide portion. The first cemented carbide portion exhibits a first concentration of nickel and the second cemented carbide portion exhibits a second concentration of nickel that is greater than the first concentration.

In an embodiment, a method of manufacturing a PDC includes positioning a cobalt source that is substantially free of nickel between a diamond volume and a cemented carbide substrate to form an assembly. The cemented carbide substrate includes a cobalt-nickel alloy cementing constituent. The method further includes subjecting the assembly to an HPHT process to form the PDC.

In some embodiments, the diamond volume includes a plurality of un-sintered diamond particles. The plurality of un-sintered diamond particles is infiltrated with cobalt from the cobalt source during HPHT processing to catalyze formation of a PCD table of the PDC. In other embodiments, the diamond volume includes an at least partially leached PCD table that is infiltrated with cobalt from the cobalt source during HPHT processing.

Other embodiments include applications utilizing the disclosed PDCs in various articles and apparatuses, such as rotary drill bits, bearing apparatuses, wire-drawing dies, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Embodiments of the invention relate to a PDC including a PCD table that is bonded to a cemented carbide substrate including a cobalt-nickel alloy cementing constituent. The cobalt-nickel alloy cementing constituent of the cemented carbide substrate provides both erosion resistance and corrosion resistance to the cemented carbide substrate. In some embodiments, the PCD table is substantially free of nickel, and the lack of a significant amount of nickel in the PCD table and the presence of cobalt in the PCD table is currently believed to catalyze diamond growth better than nickel when the PCD table is integrally formed with the cemented carbide substrate and promote mechanical integrity of the PCD table better than a nickel-infiltrated PCD table when the PCD table is a pre-sintered PCD table that is infiltrated with nickel and bonded to the cemented carbide substrate in an HPHT bonding process. The PDCs disclosed herein may be used in a variety of applications, such as rotary drill bits, bearing apparatuses, wire-drawing dies, machining equipment, and other articles and apparatuses.

Figure 1A:
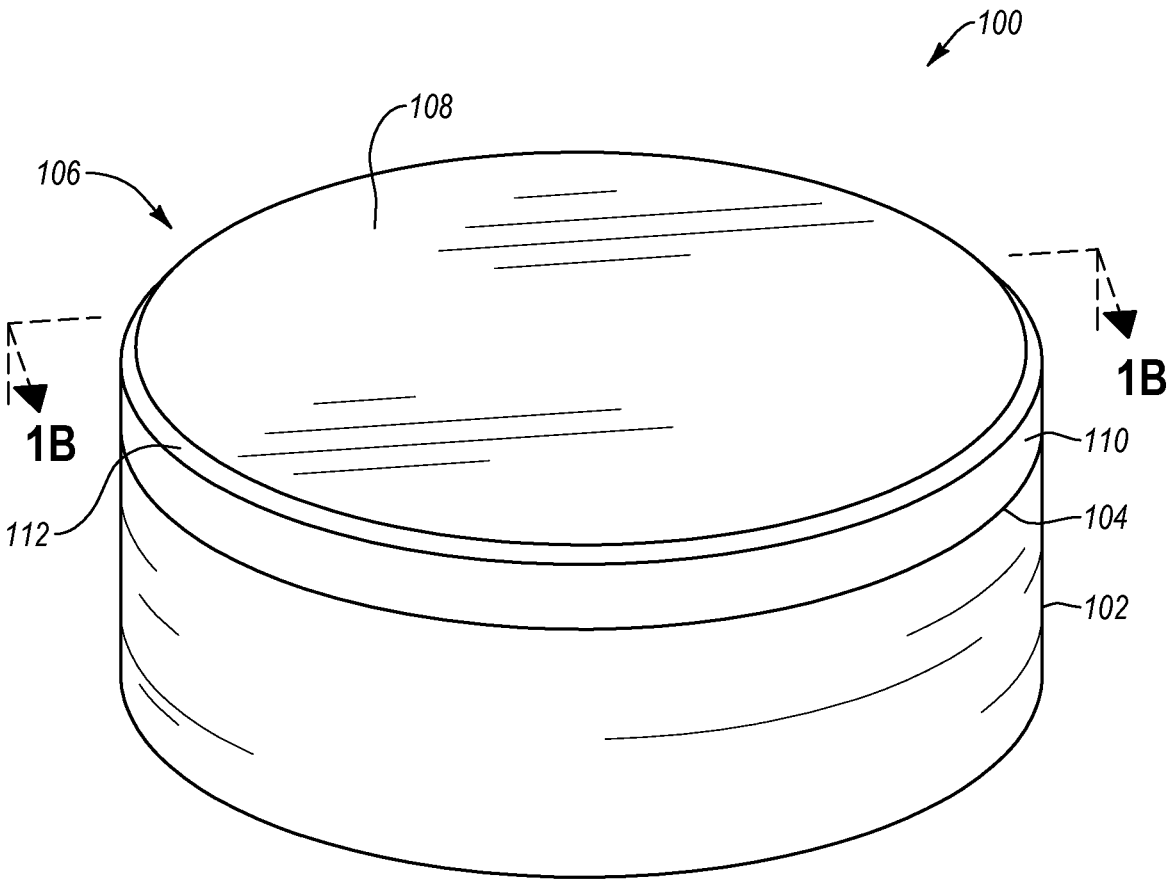
FIG. 1A is an isometric view of an embodiment of a PDC.
Figure 1B:
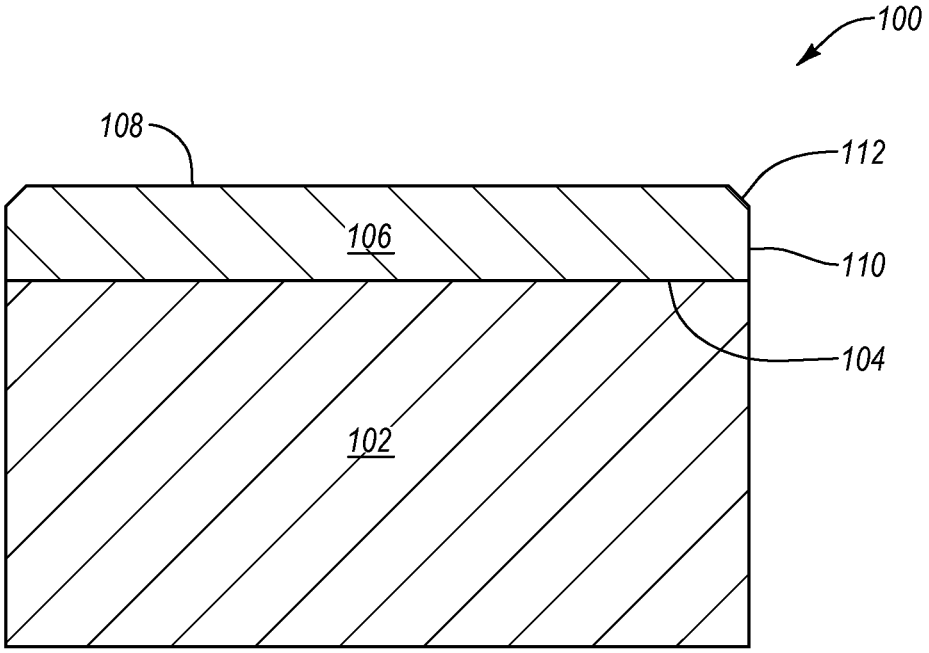
FIG. 1B is a cross-sectional view of the PDC shown in FIG. 1A taken along line 1B-1B thereof.

FIGS. 1A and 1B are isometric and cross-sectional views, respectively, of a PDC 100 according to an embodiment. The PDC 100 includes a cemented carbide substrate 102 including at least tungsten carbide grains cemented with a cobalt-nickel alloy cementing constituent. The cemented carbide substrate 102 includes an interfacial surface 104. In the illustrated embodiment, the interfacial surface 104 is substantially planar. However, in other embodiments, the interfacial surface 104 may exhibit a nonplanar topography.

The PDC 100 further includes a PCD table 106 bonded to the interfacial surface 104 of the cemented carbide substrate 102. The PCD table 106 includes a plurality of directly bonded-together diamond grains exhibiting diamond-to-diamond bonding therebetween (e.g., $sp^3$ bonding). The plurality of directly bonded-together diamond grains defines a plurality of interstitial regions.

In some embodiments, the PCD table 106 may be substantially free of nickel despite the cemented carbide substrate 102 including nickel therein and includes cobalt (e.g., substantially pure cobalt and/or a cobalt alloy) disposed in at least a portion of the interstitial regions. For example, nickel (e.g., substantially pure nickel and/or a cobalt-nickel alloy) may be present in at least a portion of the interstitial regions of the PCD table 106 in a relatively low concentration, such as about 0 wt %, about 0 wt % to about 1 wt %, less than about 0.25 wt %, about 0.10 wt % to about 0.20 wt %, about 0.010% to about 0.050 wt %, about 0.050 wt % to about 0.075 wt %, about 0.80 wt % to about 1.0 wt %, about 0.60 wt % to about 0.80 wt %, or about 0.25 wt % to about 0.50 wt %. The PCD table 106 may still be considered to be substantially free of nickel when such relative low concentrations of nickel are present therein. As will be discussed in more detail below, in some embodiments, the cobalt disposed in at least a portion of the interstitial regions may be infiltrated primarily from a cobalt source other than the cemented carbide substrate 102. For example, the cobalt may be disposed in substantially all or only a portion of the interstitial regions.

In an embodiment, the PCD table 106 may be integrally formed with (i.e., formed from diamond powder sintered on) the cemented carbide substrate 102. In another embodiment, the PCD table 106 may be a pre-sintered PCD table that is bonded to the cemented carbide substrate 102 in an HPHT bonding process.

The lack of nickel in the PCD table 106 and the presence of cobalt in the PCD table 106 is currently believed to help catalyze diamond growth better than nickel when the PCD table 106 is integrally formed with the cemented carbide substrate 102. The lack of nickel in the PCD table 106 and the presence of cobalt in the PCD table 106 is currently believed to promote mechanical integrity of the PCD table 106 when the PCD table 106 is a pre-sintered PCD table that is bonded to the cemented carbide substrate 102 in an HPHT bonding process compared to if the pre-sintered PCD table were infiltrated with nickel during the HPHT bonding process.

As will be discussed in more detail below, in some embodiments, the metallic constituent disposed in at least a portion of the interstitial regions may be infiltrated primarily from the cemented carbide substrate 102 rather than from a cobalt source that is substantially free of nickel. For example, a cobalt-nickel alloy may be disposed in substantially all or only a portion of the interstitial regions. In some embodiments, the nickel of the cobalt-nickel alloy in at least a portion of the interstitial regions of the PCD table 106 may be present in a relatively higher concentration, such as about 1 wt % or more, about 1 wt % to about 8 wt %, about 2 wt % to about 7 wt %, about 3% to about 6 wt %, about 1.5 wt % to about 6 wt %, about 1 wt % to about 3 wt %, about 1.5 wt % to about 2.5 wt %, or about 2 wt % to about 4 wt %. In this embodiment, the relative proportions of cobalt and nickel in the cobalt-nickel alloy may be approximately the same as that in the cobalt-nickel alloy cementing constituent of the cemented carbide substrate 102.

The PCD table 106 includes a working, upper surface 108, at least one lateral surface 110, and an optional chamfer 112 extending therebetween. However, it is noted that all or part of the at least one lateral surface 110 and/or the chamfer 112 may also function as a working surface. In the illustrated embodiment, the PDC 100 has a cylindrical geometry, and the upper surface 108 exhibits a substantially planar geometry. However, in other embodiments, the PDC 100 may exhibit a non-cylindrical geometry and/or the upper surface 108 of the PCD table 106 may be nonplanar, such as convex or concave.

As previously discussed, the cementing constituent of the cemented carbide substrate 102 includes a cobalt-nickel alloy. In an embodiment, the cemented carbide substrate 102 may include about 75 weight % ("wt %") to about 96 wt % tungsten carbide grains (e.g., about 84 to about 90 wt % tungsten carbide grains) cemented together with about 4 wt % to about 25 wt % of a cobalt-nickel alloy, such as about 9 wt % to about 16 wt %, about 10 wt % to about 14 wt %, or about 11 wt % to about 13 wt %. For example, the cobalt-nickel alloy serving as the cementing constituent may include about 30 wt % to about 60 wt % cobalt and about 40 wt % to about 70 wt % nickel, such as about 45 wt % to about 55 wt % cobalt and about 45 wt % to about 55 wt % nickel. In some embodiments, the amount of cobalt and nickel in the cobalt-nickel alloy cementing constituent may be substantially equal by weight %. Of course, the cobalt-nickel alloy cementing constituent may include other elements besides just cobalt and nickel, such as tungsten, carbon, other elements/constituents provided from the carbide grains of the cemented carbide substrate 102, or combinations of the foregoing. The presence of the nickel in the cemented carbide substrate 102 may enhance the corrosion resistance thereof, while the presence of the cobalt helps provide sufficient erosion resistance for the cemented carbide substrate 102.

It should be noted that cemented carbide substrate 102 may also include other carbides in addition to tungsten carbide grains. For example, the cemented carbide substrate 102 may include chromium carbide grains, tantalum carbide grains, tantalum carbide-tungsten carbide solid solution grains, or any combination thereof. Such additional carbides may be present in the cemented carbide substrate 102 in an amount ranging from about 1 wt % to about 10 wt %, such as 1 wt % to about 3 wt %.

Figure 2:
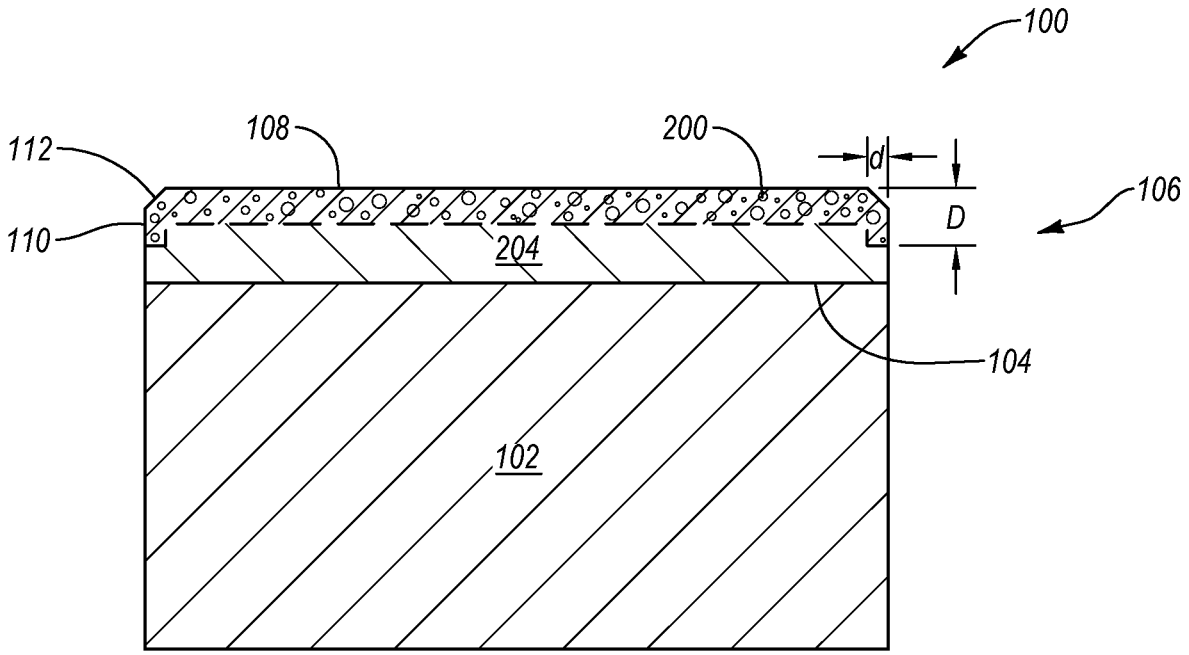
FIG. 2 is a cross-sectional view of the PDC shown in FIG. 1B after leaching a region of the PCD table that is remote from the cemented carbide substrate according to an embodiment.

FIG. 2 is a cross-sectional view of an embodiment of the PDC 100 after a selected portion of the PCD table 106 has been leached to at least partially remove the cobalt therefrom. After leaching in a suitable acid (e.g., nitric acid, hydrochloric acid, hydrofluoric acid, or mixtures thereof) for a suitable period of time (e.g., 12-24 hours), the PCD table 106 includes a leached region 200 that extends inwardly from the upper surface 108 to a selected depth D. The leached region 200 may also extend inwardly from the at least one lateral surface 110 to a selected distance d. The leached region 200 may extend along any desired edge geometry (e.g., the chamfer 112, a radius, etc.) and/or the lateral surface 110, as desired. The PCD table 106 further includes a region 204 that is relatively unaffected by the leaching process. In some embodiments, the distance d may be about equal to the depth D. The depth D may be about 10 μm to about 1000 μm, such as about 10 μm to about 500 μm, about 20 μm to about 150 μm, about 30 μm to about 90 μm, about 20 μm to about 75 μm, about 200 μm to about 300 μm, or about 250 μm to about 500 μm. The leached region 200 may still include a residual amount of cobalt, such as substantially pure cobalt and/or a cobalt alloy. For example, the residual amount of cobalt may be about 0.5 wt % to about 1.50 wt % and, more particularly, about 0.7 wt % to about 1.2 wt % of the PCD table 106.

Figure 3:
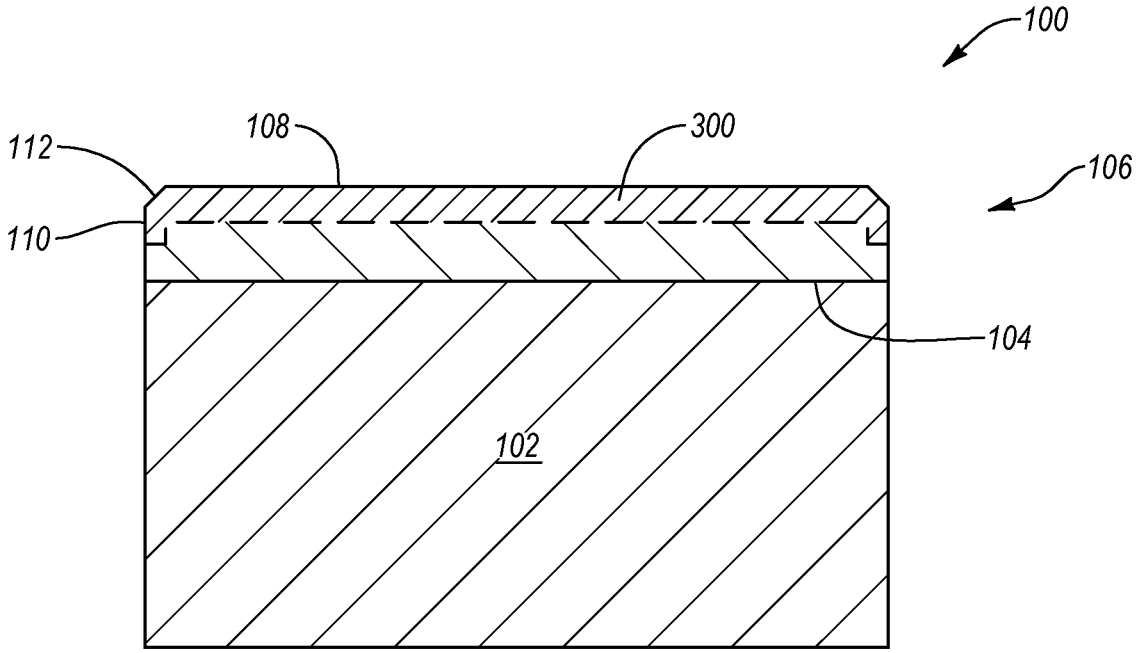
FIG. 3 is a cross-sectional view of the PDC shown in FIG. 2 after infiltrating the leached region of the PCD table with an infiltrant/replacement material according to an embodiment.

FIG. 3 is a cross-sectional view of the PDC 100 shown in FIG. 1B after infiltrating the leached region 200 of the PCD table 106 that is remote from the cemented carbide substrate 102 to form an infiltrated region 300. The infiltrant may be selected from silicon, silicon-cobalt alloys, a nonmetallic catalyst, and combinations of the foregoing. For example, the nonmetallic catalyst may be selected from a carbonate (e.g., one or more carbonates of Li, Na, K, Be, Mg, Ca, Sr, and Ba), a sulfate (e.g., one or more sulfates of Be, Mg, Ca, Sr, and Ba), a hydroxide (e.g., one or more hydroxides of Be, Mg, Ca, Sr, and Ba), elemental phosphorous and/or a derivative thereof, a chloride (e.g., one or more chlorides of Li, Na, and K), elemental sulfur and/or a derivative thereof, a polycyclic aromatic hydrocarbon (e.g., naphthalene, anthracene, pentacene, perylene, coronene, or combinations of the foregoing) and/or a derivative thereof, a chlorinated hydrocarbon and/or a derivative thereof, a semiconductor material (e.g., germanium or a germanium alloy), and combinations of the foregoing.

One suitable carbonate catalyst is an alkali metal carbonate material including a mixture of sodium carbonate, lithium carbonate, and potassium carbonate that form a low-melting ternary eutectic system. This mixture and other suitable alkali metal carbonate materials are disclosed in U.S. patent application Ser. No. 12/185,457, which is incorporated herein, in its entirety, by this reference. The alkali metal carbonate material disposed in the interstitial regions of the infiltrated region 300 may be partially or substantially completely converted to one or more corresponding alkali metal oxides by suitable heat treatment following infiltration.

Figure 4:
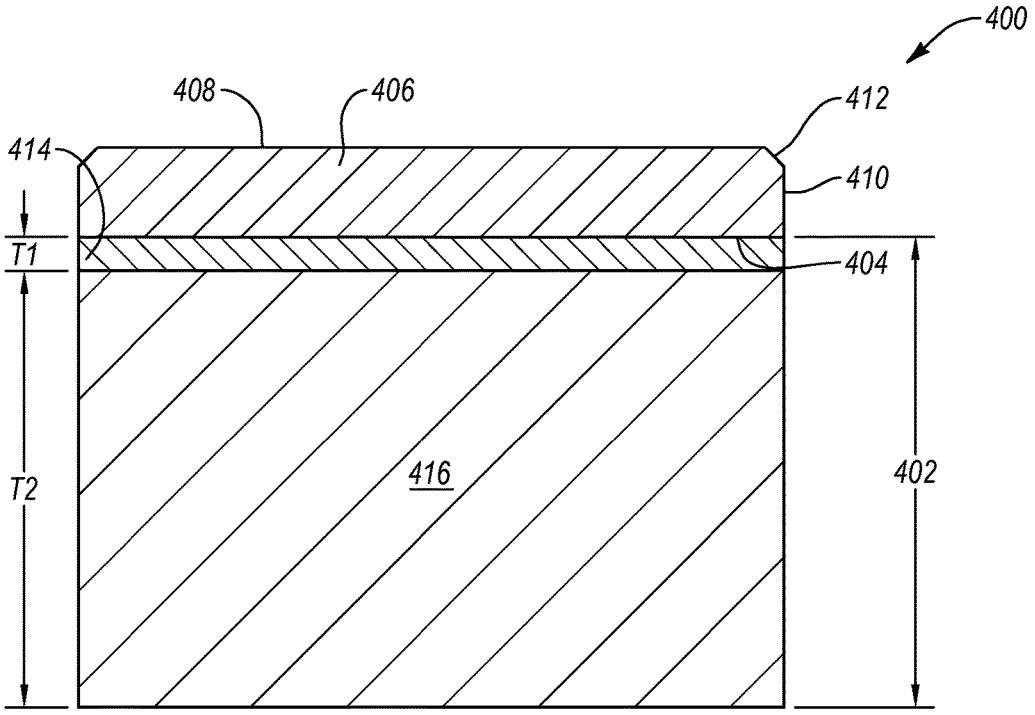
FIG. 4 is a cross-sectional view of another embodiment of a PDC in which a concentration of nickel in a PCD table thereof may be limited.

FIG. 4 is a cross-sectional view of another embodiment of a PDC 400 in which a concentration of nickel in a PCD table thereof is limited, while the cemented carbide substrate includes nickel to enhance the corrosion resistance thereof. The PDC 400 includes a cemented carbide substrate 402 having an interfacial surface 404 bonded to a PCD table 406. The PCD table 406 includes a working, upper surface 408, at least one lateral surface 410, and an optional chamfer 412 extending therebetween. The PCD table 406 further includes a plurality of directly bonded-together diamond grains exhibiting diamond-to-diamond bonding therebetween (e.g., $sp^3$ bonding). The plurality of directly bonded-together diamond grains defines a plurality of interstitial regions. The PCD table 406 further includes cobalt (e.g., substantially pure cobalt and/or a cobalt alloy) that may be disposed in at least a portion of the interstitial regions.

In an embodiment, the PCD table 406 may be integrally formed with (i.e., formed from diamond powder sintered on) the cemented carbide substrate 402. In another embodiment, the PCD table 406 may be a pre-sintered PCD table that is bonded to the cemented carbide substrate 402 in an HPHT bonding process.

Nickel may be present in the PCD table 406 in a relatively low concentration in the PCD table 406, such as about 0 wt %, about 0 wt % to about 1 wt %, less than about 0.25 wt %, about 0.10 wt % to about 0.20 wt %, about 0.010% to about 0.050 wt %, about 0.050 wt % to about 0.075 wt %, about 0.80 wt % to about 1.0 wt %, about 0.60 wt % to about 0.80 wt %, or about 0.25 wt % to about 0.50 wt %. The PCD table 406 may still be considered to be substantially free of nickel with such relatively low concentrations of nickel. The nickel may be present in the form a nickel and/or a cobalt-nickel alloy. The concentration of the nickel may be greater at the interface between the PCD table 406 and the cemented carbide substrate 402 than at the upper surface 408 of the PCD table 406.

The cemented carbide substrate 402 of the PDC 400 includes a first cemented carbide portion 414 and a second cemented carbide portion 416. The first cemented carbide portion 414 is disposed between and bonded to the PCD table 406 and the second cemented carbide portion 416. The first cemented carbide portion 414 may exhibit a thickness T1 of about 0.0050 inch to about 0.100 inch, such as about 0.0050 inch to about 0.030 inch, or about 0.020 inch to about 0.025 inch. The second cemented carbide portion 416 may exhibit a thickness T2 of about 0.30 inch to about 0.60 inch.

After HPHT processing, the first cemented carbide portion 414 exhibits a first concentration of nickel and the second cemented carbide portion 416 exhibits a second concentration of nickel that is about 1.1 to about 1.7 times (e.g., about 1.3-1.5 times) greater than the first concentration. In an embodiment, the first cemented carbide portion 414 may comprise about 9 wt % to about 16 wt % cobalt, about 0.50 wt % to about 3 wt % nickel, with the balance being substantially tungsten carbide grains. The cobalt and nickel of the first cemented carbide substrate 414 may be in the form of a cobalt-nickel alloy. The second cemented carbide portion 416 may comprise about 4 wt % to about 25 wt % of a cobalt-nickel alloy (e.g., about 9 wt % to about 16 wt %, about 10 wt % to about 14 wt %, or about 11 wt % to about 13 wt %), with the balance being substantially tungsten carbide grains cemented together by the cobalt-nickel alloy. For example, the cobalt-nickel alloy serving as the cementing constituent of the second cemented carbide portion 416 may include about 30 wt % to about 60 wt % cobalt with about 40 wt % to about 70 wt % nickel, such as about 45 wt % to about 55 wt % cobalt with about 45 wt % to about 55 wt % nickel.

In other embodiments in which the concentration of nickel in the first cemented carbide portion 414 is relatively high, the nickel of the cobalt-nickel alloy in at least a portion of the interstitial regions of the PCD table 406 may be present in a relatively higher concentration, such as about 1 wt % or more, about 1 wt % to about 8 wt %, about 2 wt % to about 7 wt %, about 3% to about 6 wt %, about 1.5 wt % to about 6 wt %, about 1 wt % to about 3 wt %, about 1.5 wt % to about 2.5 wt %, or about 2 wt % to about 4 wt %. In this embodiment, the relative proportions of cobalt and nickel in the cobalt-nickel alloy may be approximately the same as that in the cobalt-nickel alloy cementing constituent of the first cemented carbide portion 414.

Figure 5A:
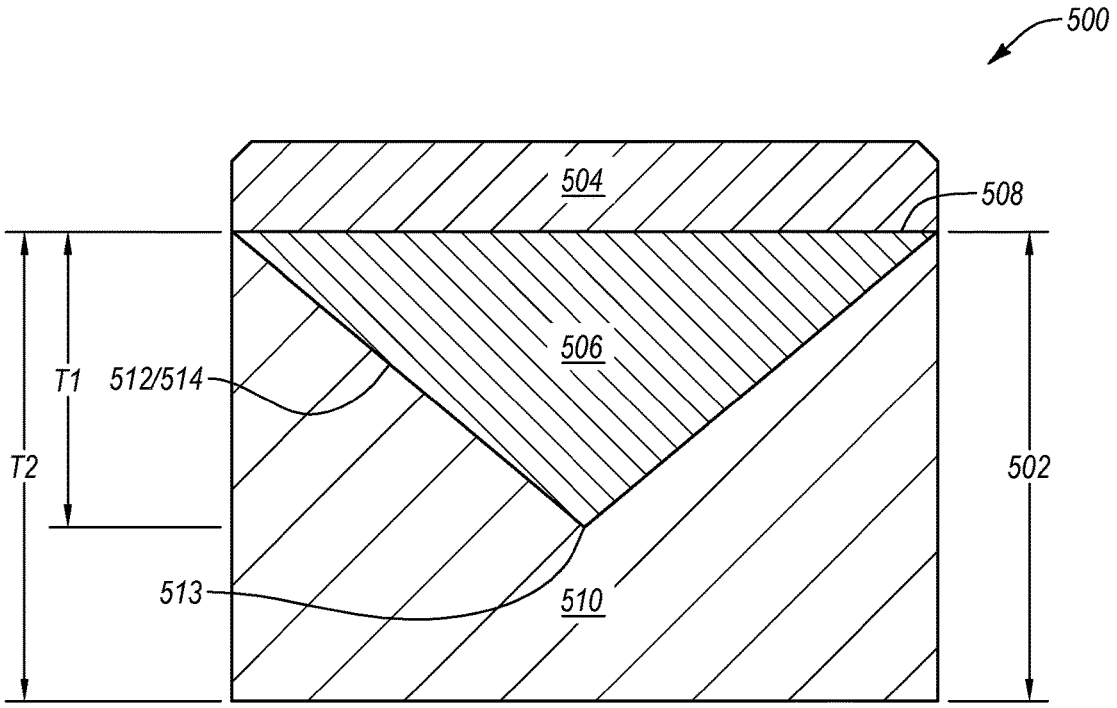
FIG. 5A is a cross-sectional view of yet another embodiment of a PDC in which a concentration of nickel in a PCD table thereof may be limited.

FIG. 5A is a cross-sectional view of yet another embodiment of a PDC 500 in which a concentration of nickel in a PCD table thereof may be limited. The PDC 500 mainly differs from the PDC 400 shown in FIG. 4 in that a cemented carbide substrate 502 of the PDC 500 is configured differently than the cemented carbide substrate 402. Therefore, in the interest of brevity, mainly the differences between the PDC 400 and the PDC 500 are described in detail below.

The PDC 500 includes a PCD table 504 (e.g., a pre-sintered or integrally formed PCD table) that may be substantially free of nickel, such as having a small concentration of nickel of, for example, about 0 wt %, about 0 wt % to about 1 wt %, less than about 0.25 wt %, about 0.10 wt % to about 0.20 wt %, about 0.010% to about 0.050 wt %, about 0.050 wt % to about 0.075 wt %, about 0.80 wt % to about 1.0 wt %, about 0.60 wt % to about 0.80 wt %, or about 0.25 wt % to about 0.50 wt %. The PCD table 504 is bonded to the cemented carbide substrate 502. The PCD table 504 may still be considered to be substantially free of nickel when such relatively low concentrations of nickel are present therein. The cemented carbide substrate 502 includes a first cemented carbide portion 506 having an interfacial surface 508 that is bonded to the PCD table 504 and a second cemented carbide portion 510 bonded to the first cemented carbide portion 506. In the illustrated embodiment, the interfacial surface 508 is substantially planar. However, in other embodiments, the interfacial surface 508 may exhibit a nonplanar topography. The first cemented carbide portion 506 may exhibit any of the compositions disclosed for the first cemented carbide portion 414 and the second cemented carbide portion 510 may exhibit any of the compositions disclosed for the second cemented carbide portion 416.

In the illustrated embodiment, the first cemented carbide portion 506 may exhibit a substantially conical geometry having a triangular cross-sectional geometry. The first cemented carbide portion 506 is received in a recess 512 formed in the second cemented carbide portion 510. The first cemented carbide portion 506 extends from the interfacial surface 508 to an apex 513 to define a thickness T1, which may be about 0.050 inch to about 0.150 inch, such as about 0.075 inch to about 0.100 inch. A thickness T2 of the second cemented carbide portion 510 may be about 0.30 inch to about 0.60 inch. The second cemented carbide portion 510 substantially surrounds and is bonded to a lateral periphery 514 of the first cemented carbide portion 506 to define an interface that is observable in, for example, a scanning electron microscope ("SEM"). By substantially surrounding the lateral periphery 514 of the first cemented carbide portion 506, the more corrosion resistant, higher nickel-content second cemented carbide portion 510 protects the lower nickel-content first cemented carbide portion 506 from corrosive drilling conditions, such as drilling mud. However, in other embodiments, the first cemented carbide portion 506 may exhibit another selected protruding geometry provided that a lateral periphery thereof is substantially surrounded by the second cemented carbide portion 510. Other complementary geometries for the first and second cemented carbide portions 506 and 510 may be employed.

In other embodiments in which the concentration of nickel in the first cemented carbide portion 506 is relatively high, the nickel of the cobalt-nickel alloy in at least a portion of the interstitial regions of the PCD table 504 may be present in a relatively higher concentration, such as about 1 wt % or more, about 1 wt % to about 8 wt %, about 2 wt % to about 7 wt %, about 3% to about 6 wt %, about 1.5 wt % to about 6 wt %, about 1 wt % to about 3 wt %, about 1.5 wt % to about 2.5 wt %, or about 2 wt % to about 4 wt %. In this embodiment, the relatively proportions of cobalt and nickel in the cobalt-nickel alloy may be approximately the same as that in the cobalt-nickel alloy cementing constituent of the first cemented carbide portion 506.

Figure 5B:
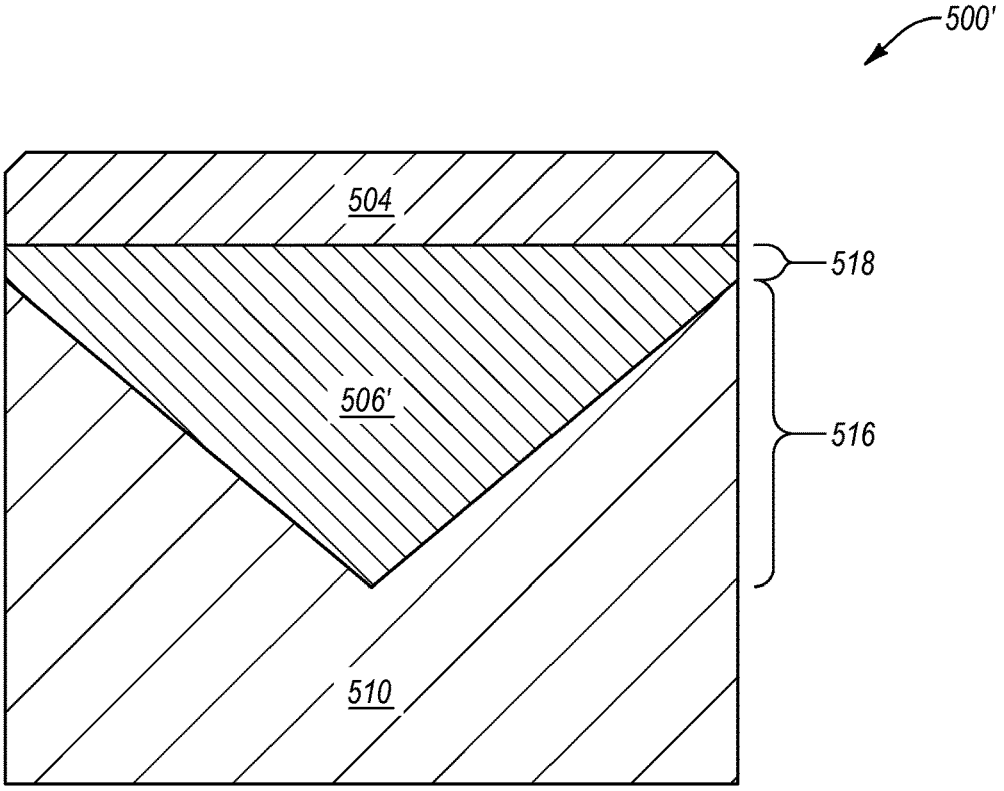
FIG. 5B is a cross-sectional view of a further embodiment of a PDC in which a concentration of nickel in a PCD table thereof may be limited.

As discussed above, the first cemented carbide portion 506 may exhibit other configurations besides the illustrated configuration shown in FIG. 5A. For example, FIG. 5B is a cross-sectional view of a PDC 500' according to another embodiment. The PDC 500' includes a first cemented carbide portion 506' comprising a substantially conical portion 516 and a disk portion 518 separately or integrally formed with the first cemented carbide portion 506'. The disk portion 518 that extends above the recess 512 is formed in the second cemented carbide portion 510 and is bonded to the PCD table 504.

The PCD tables 406 and 504 shown in FIGS. 4-5B may be leached to a selected depth to form a leached region that extends inwardly from, for example, the upper surface 408 shown in FIG. 4 (as depicted in FIG. 2). The selected depth may be about 10 μm to about 1000 μm, such as about 10 μm to about 500 μm, about 20 μm to about 150 μm, about 30 μm to about 90 μm, about 20 μm to about 75 μm, about 200 μm to about 300 μm, or about 250 μm to about 500 μm. If desired, the leached region may be infiltrated with any of the infiltrant materials disclosed herein as depicted in FIG. 2.

Figure 6A:
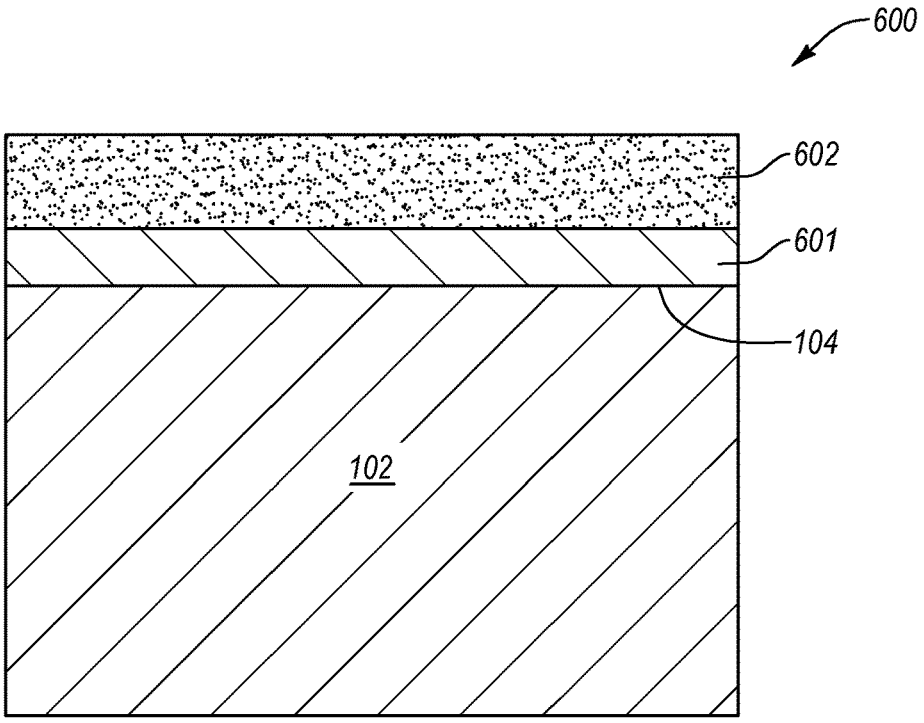
FIG. 6A is a cross-sectional view of an assembly to be HPHT processed to form the PDC shown in FIGS. 1A and 1B according to an embodiment of method.

FIG. 6A is a cross-sectional view of an assembly 600 to be HPHT processed to form the PDC shown in FIGS. 1A and 1B according to an embodiment of method. The assembly 600 includes at least one cobalt source 601 positioned between at least one layer 602 of un-sintered diamond particles (i.e., diamond powder) and the interfacial surface 104 of the cemented carbide substrate 102. For example, the cobalt source 601 may be a thin disc of cobalt-containing material, and/or particles made from a cobalt-containing material, all of which may be substantially free of nickel. For example, the cobalt-containing material may be substantially pure cobalt or a cobalt alloy, either of which may be substantially free of nickel.

The plurality of diamond particles of the at least one layer 602 may exhibit one or more selected sizes. The one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). More particularly, in various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and Another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of diamond particles may include a portion exhibiting a relatively Larger size between about 40 μm and about 15 μm and another portion exhibiting a relatively Smaller size between about 12 μm and 2 μm. The plurality of diamond particles may also include three or more different sizes (e.g., one relatively larger size and two or more relatively smaller sizes) without limitation.

The assembly 600 of the cemented carbide substrate 102, cobalt source 601, and the at least one layer 602 of diamond particles may be placed in a pressure transmitting medium, such as a refractory metal can embedded in pyrophyllite or other pressure transmitting medium. The pressure transmitting medium, including the assembly 600, may be subjected to an HPHT process using an ultra-high pressure press to create temperature and pressure conditions at which diamond is stable. The temperature of the HPHT process may be at least about 1000° C. (e.g., about 1200° C. to about 1600° C.) and the pressure of the HPHT process may be at least 4.0 GPa (e.g., about 5.0 GPa to about 10.0 GPa) for a time sufficient to sinter the diamond particles to form the PCD table 106 (FIGS. 1A and 1B). For example, the pressure of the HPHT process may be about 5 GPa to about 9 GPa and the temperature of the HPHT process may be about 1150° C. to about 1450° C. (e.g., about 1200° C. to about 1400° C.). Upon cooling from the HPHT process, the PCD table 106 becomes metallurgically bonded to the cemented carbide substrate 102. In some embodiments, the PCD table 106 may be leached to enhance the thermal stability thereof, as previously described with respect to FIG. 2 and, if desired, the leached region may be infiltrated with any of the disclosed infiltrants.

During the HPHT process, the cobalt-containing material from the cobalt source 601 may liquefy and infiltrate into the diamond particles of the at least one layer 602. The infiltrated cobalt-containing material functions as a catalyst that catalyzes formation of directly bonded-together diamond grains to sinter the diamond particles so that the PCD table 106 is formed. In an embodiment, the volume of the cobalt-containing material in the cobalt source 601 is chosen so that substantially no nickel is infiltrated into the at least one layer 602 during HPHT processing. In another embodiment, the volume of the cobalt-containing material in the cobalt source 601 is chosen so that only a small amount of nickel is infiltrated into the at least one layer 602 during HPHT processing and such nickel is primarily located in the interstitial regions proximate the interface between the PCD table 106 and the cemented carbide substrate 102. Thus, cobalt is primarily used to catalyze formation of the PCD table 106 and not nickel which is not as effective as a diamond catalyzing material.

In an embodiment, the PDC 400 shown in FIG. 4 may be fabricated by selecting the cobalt source 601 to be a cobalt-cemented tungsten carbide substrate that is substantially free of nickel. For example, the cobalt-cemented tungsten carbide substrate may comprise about 9 wt % to about 13 wt % cobalt, with the balance being substantially tungsten carbide grains. During HPHT processing the cobalt cementing constituent of the cobalt-cemented tungsten carbide substrate at least partially infiltrates into the at least one layer 602 of diamond particles to catalyze formation of the PCD table 106.

In other embodiments, the cobalt source 601 may be omitted and the at least one layer 602 of un-sintered diamond particles (i.e., diamond powder) may be positioned on the interfacial surface 104 of the cemented carbide substrate 102. In such embodiment, HPHT processing of the diamond particle and the cemented carbide substrate 102 causes the cobalt-nickel alloy cementing constituent of the cemented carbide substrate 102 to at least partially melt and infiltrate into the diamond particles to catalyze formation of the PCD table 106. In such an embodiment, the nickel of the cobalt-nickel alloy in at least a portion of the interstitial regions of the PCD table 106 may be present in a relatively higher concentration, such as about 1 wt % or more, about 1 wt % to about 8 wt %, about 2 wt % to about 7 wt %, about 3% to about 6 wt %, about 1.5 wt % to about 6 wt %, about 1 wt % to about 3 wt %, about 1.5 wt % to about 2.5 wt %, or about 2 wt % to about 4 wt %. In this embodiment, the relative proportions of cobalt and nickel in the cobalt-nickel alloy may be approximately the same as that in the cobalt-nickel alloy cementing constituent of the cemented carbide substrate 102.

Figure 6B:
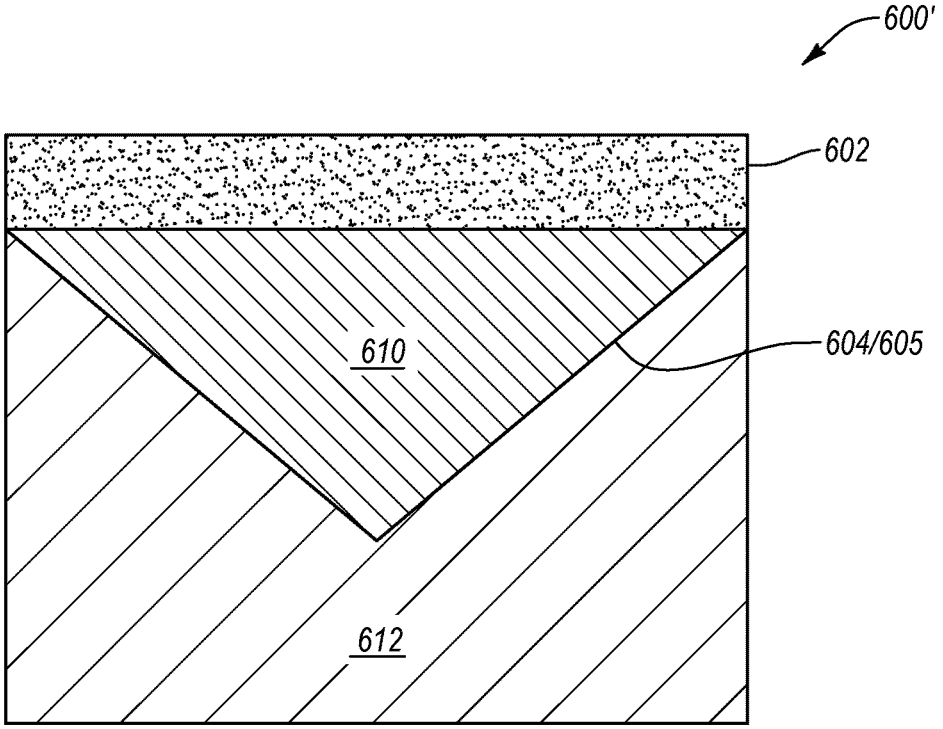
FIG. 6B is a cross-sectional view of an assembly to be HPHT processed to form the PDC shown in FIG. 5A according to another embodiment of method.

FIG. 6B is a cross-sectional view of an assembly 600' to be HPHT processed to form the PDC 500 shown in FIG. 5A according to yet another embodiment of a method. The assembly 600' may be formed by disposing a first cemented carbide portion 610 into a recess 604 formed in a second cemented carbide portion 612, and disposing the at least one layer 602 of diamond particles adjacent to the first cemented carbide portion 610. The first cemented carbide portion 610 may exhibit a substantially conical geometry or other selected geometry that may be received by the correspondingly configured recess 604 formed in the second cemented carbide portion 610. The first cemented carbide portion 610 may be a cobalt-cemented tungsten carbide substrate that is substantially free of nickel. For example, the cobalt-cemented tungsten carbide substrate may comprise about 9 wt % to about 13 wt % cobalt, with the balance being substantially tungsten carbide grains. The second cemented carbide portion 612 may exhibit any the compositions disclosed for the cemented carbide substrate 102.

The assembly 600' may be HPHT processed using any of the HPHT process conditions previously described to form the PDC 100 shown in FIGS. 1A and 1B. The first cemented carbide portion 610 serves the same function as the cobalt source 601 (FIG. 6A), which is to provide a substantially nickel-free catalyst material comprising cobalt that is infiltrated into the at least one layer 602 of diamond particles during HPHT processing. However, the less corrosion-resistant first cemented carbide portion 610 is protected from corrosive drilling conditions (e.g., drilling mud) since a lateral periphery 605 thereof is substantially surrounded by the second cemented carbide portion 612. Even after HPHT processing an interface between the first cemented carbide portion 610 and the second cemented carbide portion 612 may be apparent from microstructural examination. The PDC 500' shown in FIG. 5B may be formed in the same or similar manner to the PDC 500 by modifying the geometry of the first cemented carbide portion 610.

Figure 6C:
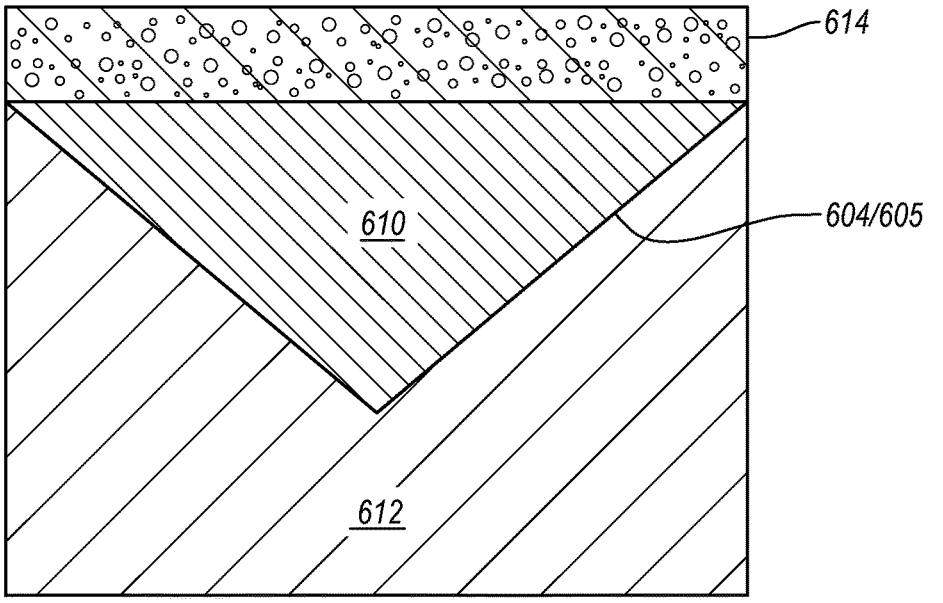
FIG. 6C is a cross-sectional view of an assembly to be HPHT processed to form the PDC shown in FIG. 5A according to yet another embodiment of method.

In another embodiment, the at least one layer 602 of diamond particles shown in FIGS. 6A and 6B may be replaced with another type of diamond volume. For example, the at least one layer 602 of diamond particles may be replaced with a porous at least partially leached PCD table that is infiltrated with a cobalt-containing material and attached to a substrate during an HPHT process using any of the diamond-stable HPHT process conditions disclosed herein. For example, the cobalt-containing material from the cobalt source 601 shown in FIG. 6A or the first cemented carbide substrate 610 shown in FIG. 6B may infiltrate into the at least partially leached PCD table. Upon cooling from the HPHT process, a strong metallurgical bond is formed between the infiltrated PCD table and the substrate. For example, FIG. 6C shows an at least partially leached PCD table 614 positioned adjacent to first cemented carbide substrate 610 of FIG. 6B to form an assembly that is HPHT processed to form the PDC 500.

The at least partially leached PCD table 614 includes a plurality of directly bonded-together diamond grains exhibiting diamond-to-diamond bonding therebetween (e.g., $sp^3$ bonding). The plurality of directly bonded-together diamond grains define a plurality of interstitial regions. The interstitial regions form a network of at least partially interconnected pores that enable fluid to flow from one side to an opposing side.

The at least partially leached PCD table 614 may be formed by HPHT sintering a plurality of diamond particles having any of the aforementioned diamond particle size distributions in the presence of a metal-solvent catalyst (e.g., iron, nickel, cobalt, or alloys thereof) under any of the disclosed diamond-stable HPHT conditions. For example, the metal-solvent catalyst may be infiltrated into the diamond particles from a metal-solvent-catalyst disc (e.g., a cobalt disc), infiltrated from a cobalt-cemented tungsten carbide substrate, mixed with the diamond particles, or combinations of the foregoing. At least a portion of or substantially all of the metal-solvent catalyst may be removed from the sintered PCD body by leaching. For example, the metal-solvent catalyst may be at least partially removed from the sintered PCD table by immersion in an acid, such as aqua regia, nitric acid, hydrofluoric acid, or other suitable acid, to form the at least partially leached PCD table. The sintered PCD table may be immersed in the acid for about 2 to about 7 days (e.g., about 3, 5, or 7 days) or for a few weeks (e.g., about 4 weeks) depending on the amount of leaching that is desired. It is noted that a residual amount of the metal-solvent catalyst may still remain even after leaching for extended periods of time.

When the metal-solvent catalyst is infiltrated into the diamond particles from a cemented tungsten carbide substrate including tungsten carbide grains cemented with a metal-solvent catalyst (e.g., cobalt, nickel, iron, or alloys thereof), the infiltrated metal-solvent catalyst may carry tungsten and/or tungsten carbide therewith. The at least partially leached PCD table may include such tungsten and/or tungsten carbide therein disposed interstitially between the bonded diamond grains. The tungsten and/or tungsten carbide may be at least partially removed by the selected leaching process or may be relatively unaffected by the selected leaching process.

If desired, after infiltrating and bonding the at least partially leached PCD table to the cemented carbide substrate, the cementing constituent that occupies the interstitial regions may be at least partially removed in a subsequent leaching process using an acid (e.g., aqua regia, nitric acid, hydrofluoric acid, or other suitable acid) to form, for example, the leached region 200 shown in FIG. 2. If desired, the leached region 200 may be infiltrated with any of the infiltrant materials disclosed herein.

Figure 7A:
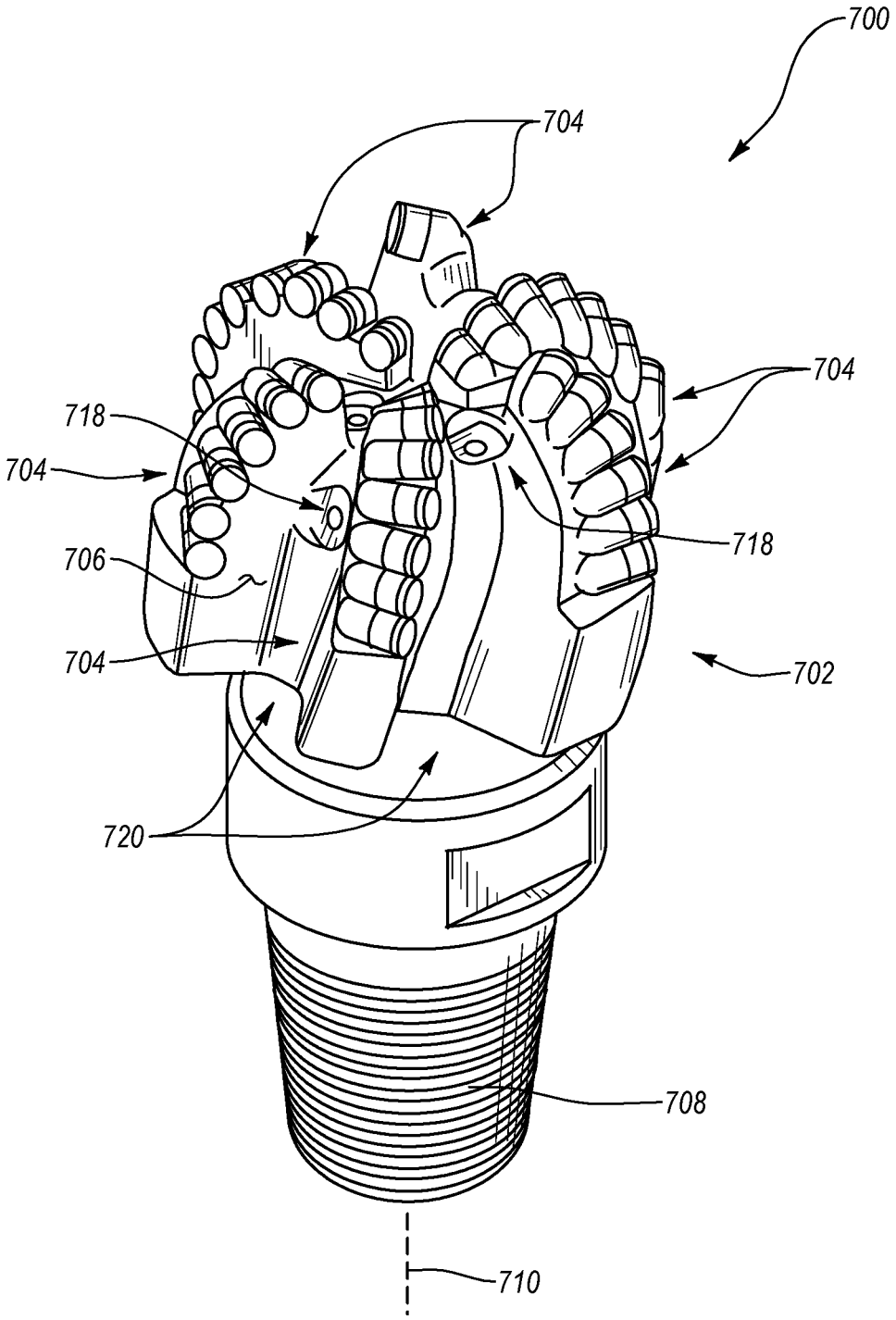
FIG. 7A is an isometric view of an embodiment of a rotary drill bit that may employ one or more of the disclosed PDC embodiments.
Figure 7B:
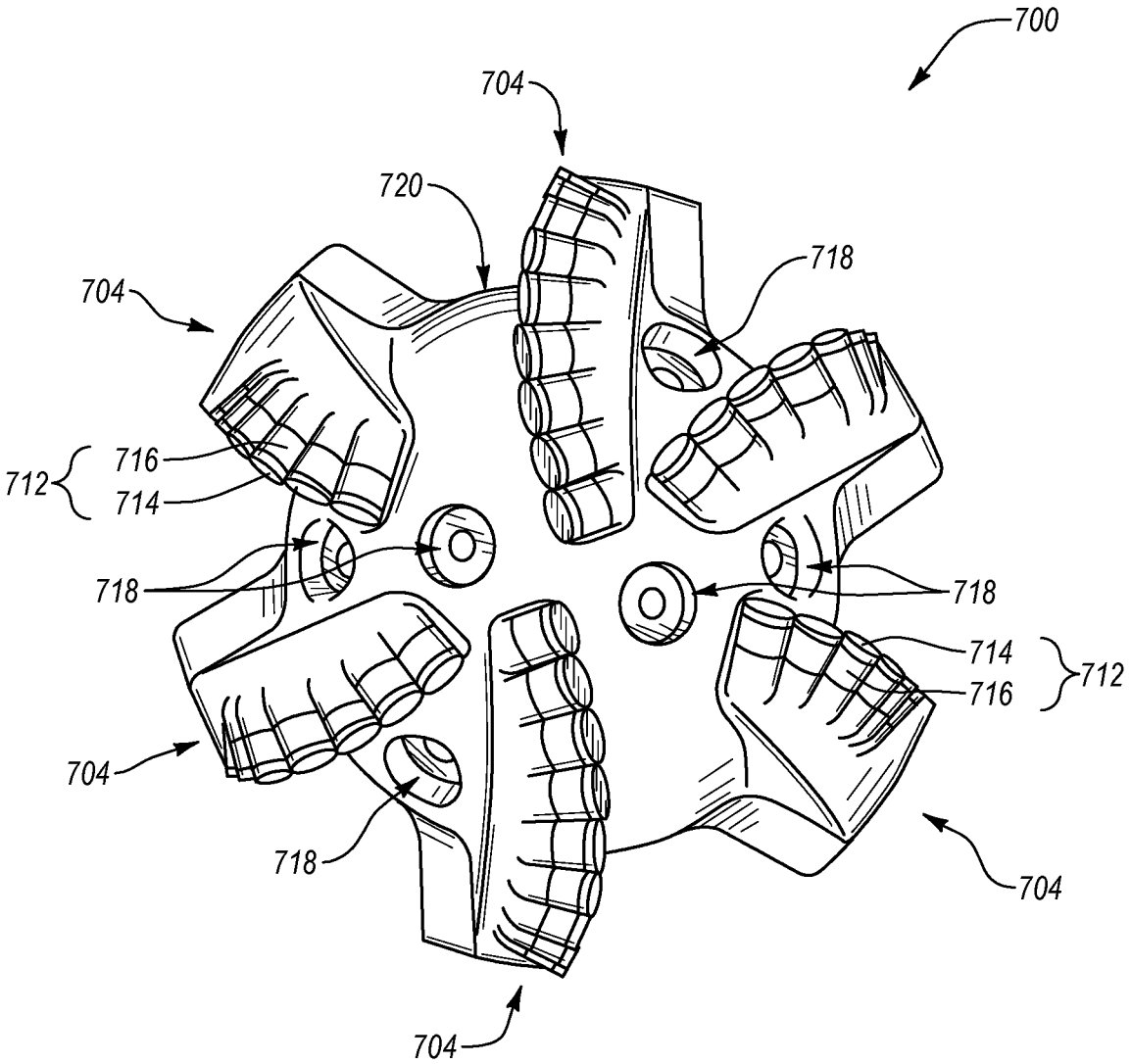
FIG. 7B is a top elevation view of the rotary drill bit shown in FIG. 7A.

FIG. 7A is an isometric view and FIG. 7B is a top elevation view of an embodiment of a rotary drill bit 700. The rotary drill bit 700 includes at least one PDC configured according to any of the previously described PDC embodiments, such as the PDC 100 of FIGS. 1A and 1B. The rotary drill bit 700 comprises a bit body 702 that includes radially- and longitudinally-extending blades 704 having leading faces 706, and a threaded pin connection 708 for connecting the bit body 702 to a drilling string. The bit body 702 defines a leading end structure for drilling into a subterranean formation by rotation about a longitudinal axis 710 and application of weight-on-bit. At least one PDC, configured according to any of the previously described PDC embodiments, may be affixed to the bit body 702. With reference to FIG. 7B, each of a plurality of PDCs 712 is secured to the blades 704 of the bit body 702 (FIG. 7A). For example, each PDC 712 may include a PCD table 714 bonded to a substrate 716. More generally, the PDCs 712 may comprise any PDC disclosed herein, without limitation. In addition, if desired, in some embodiments, a number of the PDCs 712 may be conventional in construction. Also, circumferentially adjacent blades 704 define so-called junk slots 720 therebetween. Additionally, the rotary drill bit 700 includes a plurality of nozzle cavities 718 for communicating drilling fluid from the interior of the rotary drill bit 700 to the PDCs 712.

FIGS. 7A and 7B merely depict one embodiment of a rotary drill bit that employs at least one PDC fabricated and structured in accordance with the disclosed embodiments, without limitation. The rotary drill bit 700 is used to represent any number of earth-boring tools or drilling tools, including, for example, core bits, roller-cone bits, fixed-cutter bits, eccentric bits, bicenter bits, reamers, reamer wings, or any other downhole tool including superabrasive compacts, without limitation.

The PDCs disclosed herein (e.g., the PDC 100 shown in FIGS. 1A and 1B) may also be utilized in applications other than cutting technology. For example, the disclosed PDC embodiments may be used in wire dies, bearings, artificial joints, inserts, cutting elements, and heat sinks. Thus, any of the PDCs disclosed herein may be employed in an article of manufacture including at least one superabrasive element or compact.

Thus, the embodiments of PDCs disclosed herein may be used on any apparatus or structure in which at least one conventional PDC is typically used. In one embodiment, a rotor and a stator, assembled to form a thrust-bearing apparatus, may each include one or more PDCs (e.g., the PDC 100 shown in FIGS. 1A and 1B) configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing superabrasive compacts disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PDCs disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,460,233; 5,544,713; 5,180,022; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A polycrystalline diamond compact, comprising:

a cemented carbide substrate including at least nickel and cobalt, wherein the cemented carbide substrate includes a portion having about 0.50 weight % to about 3 weight % nickel and about 9 weight % to about 16 weight % cobalt and a portion including a cementing constituent having about 40 weight % to about 70 weight % nickel and about 30 weight % to about 60 weight % cobalt; and a polycrystalline diamond table bonded to the cemented carbide substrate, the polycrystalline diamond table including a plurality of bonded-together diamond grains defining a plurality of interstitial regions, at least a portion of interstitial regions including cobalt disposed therein.

2. The polycrystalline diamond compact of claim 1, wherein the cementing constituent having about 40 weight % to about 70 weight % nickel and about 30 weight % to about 60 weight % cobalt includes about 45 weight % to about 55 weight % nickel and about 45 weight % to about 55 weight % cobalt.

3. The polycrystalline diamond compact of claim 1, wherein the cementing constituent having about 40 weight % to about 70 weight % nickel and about 30 weight % to about 60 weight % cobalt includes about 40 weight % to about 55 weight % nickel and about 45 weight % to about 60 weight % cobalt.

4. The polycrystalline diamond compact of claim 1, wherein the cementing constituent having about 40 weight % to about 70 weight % nickel and about 30 weight % to about 60 weight % cobalt includes about 45 weight % to about 70 weight % nickel and about 30 weight % to about 55 weight % cobalt.

5. The polycrystalline diamond compact of claim 1, wherein the cementing constituent having about 40 weight % to about 70 weight % nickel and about 30 weight % to about 60 weight % cobalt includes more cobalt than nickel.

6. A polycrystalline diamond compact, comprising:

a cemented carbide substrate including at least nickel and cobalt, wherein the cemented carbide substrate includes at least a portion having about 0.50 weight % to about 3 weight % nickel and about 9 weight % to about 16 weight % cobalt; and a polycrystalline diamond table bonded to the cemented carbide substrate, the polycrystalline diamond table including a plurality of bonded-together diamond grains defining a plurality of interstitial regions, at least a portion of interstitial regions including cobalt disposed therein.

7. The polycrystalline diamond compact of claim 6, wherein the cemented carbide substrate includes a cementing constituent having more cobalt than nickel in an additional portion of the cemented carbide substrate.

8. The polycrystalline diamond compact of claim 6, wherein the cemented carbide substrate includes a cementing constituent having more nickel than cobalt in an additional portion of the cemented carbide substrate.

9. The polycrystalline diamond compact of claim 6, wherein the cemented carbide substrate includes a cementing constituent having about 40 weight % to about 70 weight % nickel and about 30 weight % to about 60 weight % cobalt in an additional portion of the cemented carbide substrate.

* * * * *